United States Patent [19]

Timmermans et al.

[11] 4,395,048

[45] Jul. 26, 1983

[54] PUMP SAFETY DEVICE

[75] Inventors: Francis Timmermans, Jeumont; Jean Vandervorst, Ferriere la Grande, both of France

[73] Assignee: Jeumont-Schneider, Puteaux, France

[21] Appl. No.: 306,615

[22] PCT Filed: Jan. 22, 1981

[86] PCT No.: PCT/FR81/00006

§ 371 Date: Sep. 24, 1981

§ 102(e) Date: Sep. 24, 1981

[87] PCT Pub. No.: WO81/02184

PCT Pub. Date: Aug. 6, 1981

[30] Foreign Application Priority Data

Jan. 24, 1980 [FR] France ..... 80 01517

[51] Int. Cl.[3] ..... F16J 15/38

[52] U.S. Cl. ..... 277/65; 277/96.1; 415/113; 415/170 A

[58] Field of Search ..... 415/110, 111, 112, 113, 415/170 R, 174, 170 A; 277/9, 27, 65, 59, 74, 91

[56] References Cited

U.S. PATENT DOCUMENTS

| | | | |
|---|---|---|---|
| 3,096,985 | 7/1963 | Biheller | 277/53 |
| 3,717,352 | 2/1973 | Jansing et al. | 277/59 |
| 4,021,254 | 1/1978 | Raimondi et al. | 277/3 |
| 4,174,843 | 11/1979 | Arena et al. | 277/27 |
| 4,212,475 | 7/1980 | Sedy | 277/91 |
| 4,230,324 | 10/1980 | Derman | 415/110 |

FOREIGN PATENT DOCUMENTS

| | | |
|---|---|---|
| 329380 | 5/1976 | Austria . |
| 1504545 | 12/1967 | France . |

*Primary Examiner*—Harvey C. Hornsby
*Assistant Examiner*—Michael Knick
*Attorney, Agent, or Firm*—Schwartz, Jeffery, Schwaab, Mack, Blumenthal & Koch

[57] ABSTRACT

The safety device insures the longitudinal tightness of a pump shaft in the case where the pump dynamic gasket separating the high pressure chamber from the low pressure chamber of the pump brakes. According to the invention, the device comprises a cylindrical hollow piston coaxially surrounding the pump shaft and the structure allowing the axial displacement of the piston in order to compress a toroidal safety gasket between the shaft and the piston in the event of a failure of the dynamic gasket.

10 Claims, 2 Drawing Figures

PUMP SAFETY DEVICE

The present invention concerns a safety device insuring the longitudinal tightness of the shaft of a pump in the case of the rupture of the dynamic gasket separating the high pressure fluid chamber from the low pressure fluid chamber of the pump.

Such a device is particularly provided for application to the primary pumps of nuclear reactors.

In produce, primary pumps effect the circulation of cooling fluid in the reactor. This fluid is generally contaminated with radioactivity.

A set of three dynamic gaskets of the leakage type, placed successively, normally assure the longitudinal tightness of the shaft. However, in case of the failure of one of these gaskets, the downstream elements are exposed to a pressure for which they are not designed and, after the possible rupture of the gaskets located downstream, the contaminated fluid under pressure is released and fills the pressure vessel itself of the the reactor.

SUMMARY OF THE INVENTION

It is the object of the present invention to eliminate this disadvantage by means of a safety device that is readily applied to primary pumps in service.

The device according to the invention is intended to operate only in the case of the failure of one of the gaskets so that it cannot be used when it should perform its function.

According to the present invention, the device comprises a cylindrical hollow piston coaxially surrounding the shaft of the pump and is normally housed in a chamber provided for this purpose in the stationary housing of the dynamic gasket separating the high pressure chamber from the low pressure chamber and means to displace said piston coaxially so as to compress a toroidal safety seal between the shaft and the piston in the event of a failure of the dynamic gasket.

BRIEF DESCRIPTION OF THE DRAWINGS

The invention will be better understood and other objects, advantages and characteristics will become more apparent from the description hereinafter of two preferred embodiments presented in a nonlimiting manner, to which two sheets of drawings are attached.

DETAILED DESCRIPTION OF THE PREFERRED EMBODIMENTS

Figure 1:
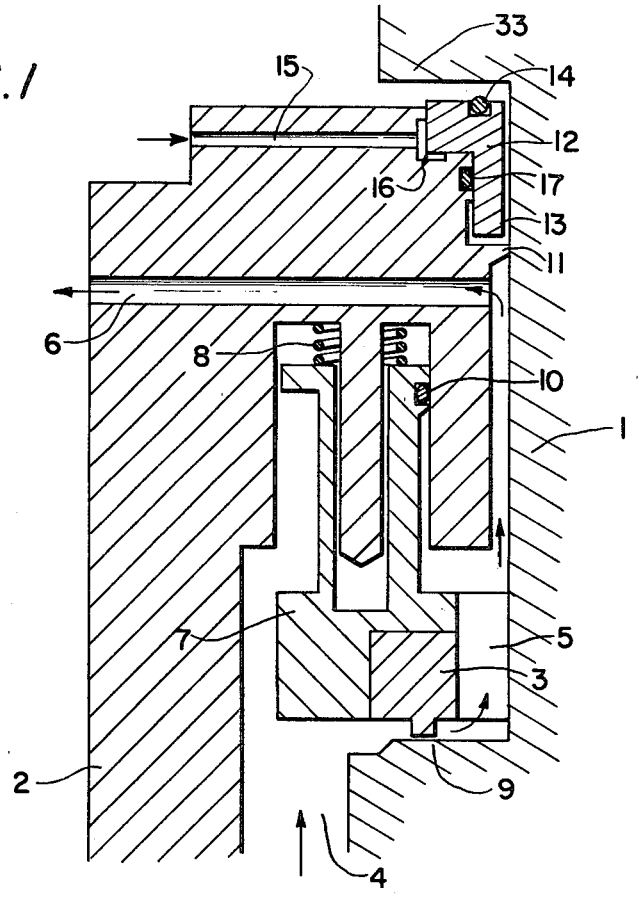
FIG. 1 is a schematic axial cross section of a device according to a first embodiment of the invention.

Referrring now to FIG. 1, the pump, the symmetry axis of which is shown by a dot-and-dash line, comprises a rotating shaft 1 and a casing 2 of the dynamic gasket fixed in rotation. The fluid circulating in the pump is at a high pressure in the chamber 4 and leaks past dynamic gasket 3 into the chamber 5, wherein a pressure lower than that of chamber 5 prevails. The leakage of the fluid is conducted along the shaft 1 and is evacuated through the conduit 6 in communication with the low prssure chamber 5.

In a known manner, the dynamic gasket 3 is integral with a floating bushing 7 which moves in translation and a compressed spring 8 maintains the gasket 3 in tight contact with the part 9 of the shaft so that only a fluid film escapes from the from the high pressure chamber 4 to the low pressure chamber 5 and insures the necessary relative sliding of the parts without heating.

A static toroidal gasket 10 is placed between the bushing 7 and the casing 2 to prevent any nonfunctional leakage of the fluid between the two chambers 4 and 5.

Without the device according to the invention, in case of the rupture of the gasket 3, the chamber 5 must support the high pressure of the chamber 4.

The evacuating conduit 6 becomes inoperative and the fluid under pressure, escaping through the narrowing 11, floods the enclosure of the reactor. To eliminate this difficulty, the safety device provided essentially comprises a piston 12 and means to displace this piston axially so that it is applied against the rim 33 provided for this purpose on the shaft 1, thereby compressing a toroidal gasket 14 to reduce and eliminate the escape of the fluid into the reactor enclosure. The preferred means to displace the piston 12 consist of an auxiliary source of fluid under pressure, for example, air compressed to a pressure between 5 and 10 bars, connected with a conduit 15 in communication with a chamber 16. A static torodial gasket 17 prevents any mixture of the different fluids under pressure.

Except in a complete failure of the gasket or gaskets of the pump, the fluid does not escape through the narrowing 11 and the piston 12 may remain in the chamber 13 provided for this purpose in the casing 2. In this manner, the toroidal gasket 14 is not exposed to previous wear and retains its effectiveness when needed.

During a failure of a dynamic gasket and more accurately, of the gasket 3, the fluid overflows through the narrowing 11. It is then possible to limit the leakage by first slowing the pump and then stopping it after connecting the auxiliary source of fluid under pressure with the conduit 15. The piston 12 then moves axially and compresses the gasket 14 against the rim 13, which has been, optionally covered by material reducing friction, such as graphite. When the piston 12 is displaced, the chamber 13 again serves as the cylinder for the piston 12, since it is filled with fluid under pressure from the chamber 4. Means are provided to subsequently disconnect the auxiliary source from the conduit, because the necessary effect is insured by the fluid normally under pressure.

Figure 2:
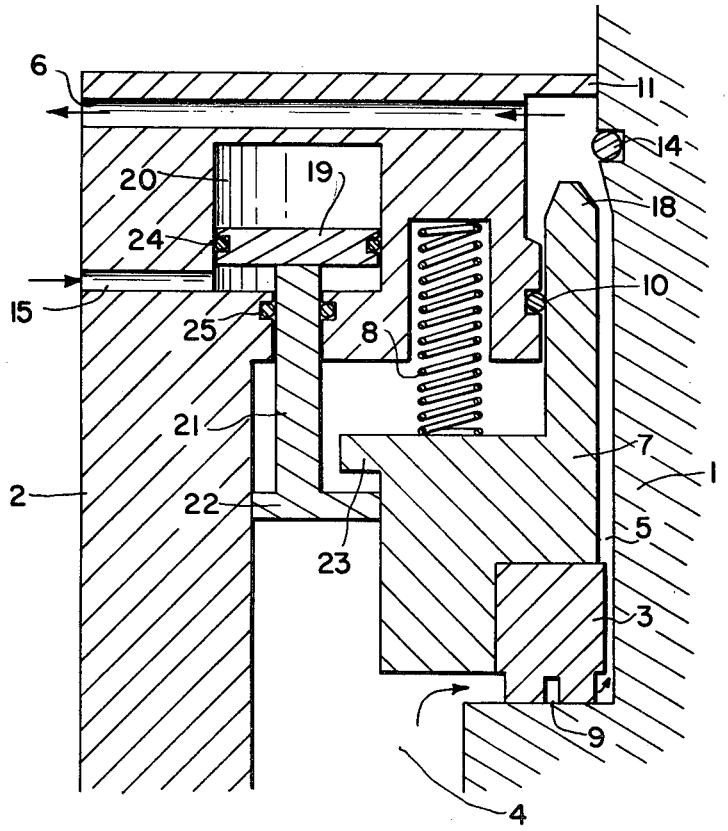
FIG. 2 is a schematic axial cross section of a device according to a second embodiment of the invention insuring.

A second embodiment of a device according to the invention is shown schematically in FIG. 2 for a more powerful pump. In this figure, the elements similar to those in FIG. 1 carry the same references.

According to this embodiment, the bushing 7 constitutes the piston for the case of a failure of the gasket 3. In effect, by means of the axial displacement of the bushing 7, the toroidal gasket 14 forming the rim around the shaft of the pump is compressed by the end 18 of the bushing 7 so as to insure tightness upstream from the narrowing 11 and consequently, to prevent the leakage of fluid under pressure through the narrowing 11.

To effect the displacement of the bush 7, auxiliary pistons 19 are, for example, placed in the casing 2.

Preferably, these auxiliary pistons are three in number and are distributed around the shaft 1 of the pump, in the cylinders 20 provided for the purpose.

The rod 21 of each piston 19 is provided at its end with a protruding stop 22.

During the displacement of the piston 19, the stop 22 contacts a collar 23 integral with the bushing 7 which thereby is moved by translation of the piston 19.

To displace the piston 19, an auxiliary source of fluid under pressure is connected with the conduit 15 in communication with one of the parts of the cylinder 20. The segments 24 on the one hand, and the toroidal gaskets 25 on the other, insure the tightness of the device.

In the same manner as before, when the joint 14 is compressed, the auxiliary source may be disconnected, because the fluid under pressure in the chamber 4, communicating with the chamber 5, then tends to apply pressure to the bushing 7, thereby providing the effect required by itself.

Obviously, to make the operation of the device possible at low rotating velocities of the shaft, the end 18 of the bushing 7 may also be coated with a layer of a friction reducing material.

Such a coating, however, is not necessary if the safety device is intended to be operated only after the shaft of the pump stops completely.

Even though only two embodiments of the invention have been described, it is evident that any modification applied by persons skilled in the art in the same spirit will not exceed the scope of the present invention.

For example, the means to insure the displacement of the piston may equally be of the electrical type, an electric coil then being arranged in an appropriate manner in the casing 2 and connected with an external source of electric power.

We claim:

1. A pump having a casing, a pump shaft rotatably mounted within said casing, a high pressure fluid chamber, a low pressure fluid chamber, and a dynamic gasket mounted in said casing and contacting said shaft for separating said high pressure chamber from said low pressure chamber and a safety device, comprising:

a compressible safety gasket;

a cylindrical piston coaxially surrounding said shaft and having a first sealing surface facing a second sealing surface on said shaft with said safety gasket received therebetween, said first sealing surface being spaced from said second sealing surface by an amount such that said safety gasket is in an uncompressed state, said cylindrical piston being mounted in a chamber formed in said casing for movement axially of said shaft; and means for moving said cylindrical piston axially of said shaft to compress said safety gasket between said first and second sealing surfaces in the event of a rupture of said dynamic gasket, whereby, while said dynamic gasket is operative, said safety gasket is not used, but when said dynamic gasket ruptures and high pressure fluid enters said low pressure chamber, said safety gasket is compressed to prevent leakage of fluid from said low pressure chamber.

2. The device according to claim 1, wherein said safety gasket is toroidal.

3. The device according to claim 1, wherein said dynamic gasket is mounted on one axiallly facing end of said cylindrical piston and said first sealing surface is formed on an opposite axially facing end of said cylindrical piston whereby said means for moving said cylindrical piston axially causes said dynamic gasket to open when causing said safety gasket to be compressed.

4. The device according to claim 1, wherein said means comprises an auxiliary source of fluid under pressure connected through a conduit to said chamber formed in said casing.

5. The device according to claim 1, wherein said dynamic gasket is connected directly to said cylindrical piston.

6. The device according to claim 5, wherein said means comprises an auxiliary piston mounted in a cylinder formed in said casing, said auxiliary piston including a rod equipped with a protruding stop, said stop cooperating with a collar integral with said cylindrical piston, and an auxiliary source of fluid connected to said cylinder, whereby translatory movement of said auxiliary piston causes translatory movement of said cylindrical piston and the compression of said safety gasket.

7. The device according to claim 1 or 11, wherein a portion of the surface of said safety gasket is coated with a layer of friction reducing material for reducing friction during compression of said safety gasket.

8. The device according to claims 4, 5 or 6, wherein said auxiliary source of fluid comprises compressed air under a pressure of 5 to 10 bars.

9. The device according to claims 4, 5 or 6, wherein said cylindrical piston includes an actuation surface exposed to high pressure fluid from said high pressure chamber when said safety gasket has ruptured, whereby said cylindrical piston is maintained in its axially displaced positioned by said high pressure fluid once said piston has been displaced by said means.

10. The device according to claim 9, and further including means to disconnect said auxiliary source when said safety gasket is compressed whereby said high pressure fluid maintains said cylindrical piston in its displaced position.

* * * * *

UNITED STATES PATENT AND TRADEMARK OFFICE

CERTIFICATE OF CORRECTION

PATENT NO. : 4,395,048

DATED : July 26, 1983

INVENTOR(S) : Francis Timmermans, et al

It is certified that error appears in the above-identified patent and that said Letters Patent is hereby corrected as shown below:

The title page should be deleted to appear as per attached title page.

Signed and Sealed this

*Twentieth* Day of *March 1984*

[SEAL]

*Attest:*

GERALD J. MOSSINGHOFF

*Attesting Officer*

*Commissioner of Patents and Trademarks*

United States Patent [19]

Timmermans et al.

[11] 4,395,048

[45] Jul. 26, 1983

[54] PUMP SAFETY DEVICE

[75] Inventors: Francis Timmermans, Jeumont; Jean Vandervorst, Ferriere la Grande, both of France

[73] Assignee: Jeumont-Schneider, Puteaux, France

[21] Appl. No.: 306,615

[22] PCT Filed: Jan. 22, 1981

[86] PCT No.: PCT/FR81/00006

§ 371 Date: Sep. 24, 1981

§ 102(e) Date: Sep. 24, 1981

[87] PCT Pub. No.: WO81/02184

PCT Pub. Date: Aug. 6, 1981

[30] Foreign Application Priority Data

Jan. 24, 1980 [FR] France ..... 80 01517

[51] Int. Cl.[3] ..... F16J 15/38

[52] U.S. Cl. ..... 277/65; 277/96.1; 415/113; 415/170 A

[58] Field of Search ..... 415/110, 111, 112, 113, 415/170 R, 174, 170 A; 277/9, 27, 65, 59, 74, 91

[56] References Cited

U.S. PATENT DOCUMENTS

| | | | |
|---|---|---|---|
| 3,096,985 | 7/1963 | Biheller | 277/53 |
| 3,717,352 | 2/1973 | Jansing et al. | 277/59 |
| 4,021,254 | 1/1978 | Raimondi et al | 277/3 |
| 4,174,843 | 11/1979 | Arena et al. | 277/27 |
| 4,212,475 | 7/1980 | Sedy | 277/91 |
| 4,230,324 | 10/1980 | Derman | 415/110 |

FOREIGN PATENT DOCUMENTS

| | | |
|---|---|---|
| 329380 | 5/1976 | Austria . |
| 1504545 | 12/1967 | France . |

*Primary Examiner*—Harvey C. Hornsby
*Assistant Examiner*—Michael Knick
*Attorney, Agent, or Firm*—Schwartz, Jeffery, Schwaab, Mack, Blumenthal & Koch

[57] ABSTRACT

The safety device insures the longitudinal tightness of a pump shaft in the case where the pump dynamic gasket separating the high pressure chamber from the low pressure chamber of the pump brakes. According to the invention, the device comprises a cylindrical hollow piston coaxially surrounding the pump shaft and the structure allowing the axial displacement of the piston in order to compress a toroidal safety gasket between the shaft and the piston in the event of a failure of the dynamic gasket.

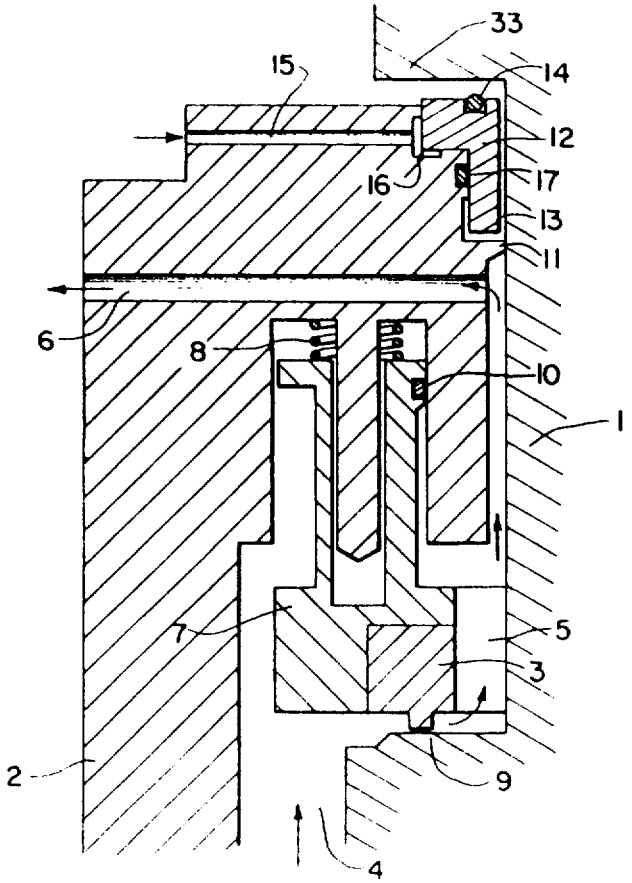

10 Claims, 2 Drawing Figures